United States Patent [19]

Hollis

[11] 4,119,032

[45] Oct. 10, 1978

[54] PRINTING PRESS WITH REMOVABLE PRINTING ROLL SLEEVE

[75] Inventor: Richard John Hollis, Bristol, England

[73] Assignee: Strachan & Henshaw Limited, Bristol, England

[21] Appl. No.: 801,347

[22] Filed: May 27, 1977

[30] Foreign Application Priority Data

Jun. 2, 1976 [GB] United Kingdom ..... 22847/76

[51] Int. Cl.[2] ..... B41F 27/10

[52] U.S. Cl. ..... 101/216; 101/375; 101/426

[58] Field of Search ..... 101/152, 153, 375, 376, 101/216, 212, 219, 174, 378, 415.1; 100/155 R, 168, 176

[56] References Cited

U.S. PATENT DOCUMENTS

| | | | |
|---|---|---|---|
| 1,329,325 | 1/1920 | Mascord | 101/216 |
| 2,605,701 | 8/1952 | Huebner | 101/216 |
| 2,925,037 | 2/1960 | Fischer | 101/216 |

FOREIGN PATENT DOCUMENTS

| | | | |
|---|---|---|---|
| 1,035,329 | 7/1966 | United Kingdom | 101/216 |

*Primary Examiner*—J. Reed Fisher

*Attorney, Agent, or Firm*—Omri M. Behr

[57] ABSTRACT

A printing roll is mounted in a printing machine in such a way that a sleeve on its outer surface can be removed axially while the roll remains substantially in its working position. One end bearing of the roll is free of axial restraint relative to the roll and is removably secured to a side frame of the machine. For axial positioning, an adjustable restrainer engages the roll axle at that end. Beyond the other side frame a counterpoise acts on the roll axle to support the roll when the one end bearing is removed. The counterpoise may be a hydraulically operated pull roll, permanently engaged to the roll axle through a yoke and a rolling contact bearing.

10 Claims, 6 Drawing Figures

PRINTING PRESS WITH REMOVABLE PRINTING ROLL SLEEVE

FIELD OF THE INVENTION

Figure 1:
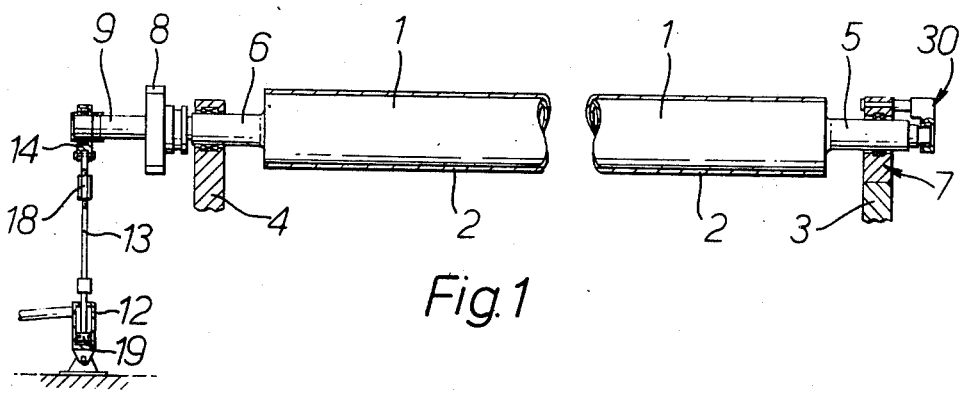

This invention relates to printing presses of the type in which the printing roll is provided with a removable sleeve. These rolls are used e.g. in flexographic printing for transferring an image to the substance being printed.

BACKGROUND OF THE INVENTION

Printing sleeves are removable from the rolls by various known means, some employing air under pressure (see U.S. Pat. No. 3,146,709) and others radial expansion upon axial contraction (see U.S. Pat. No. 2,450,727). In particular there has recently been proposed, in U.S.A. co-pending patent application Ser. No. 755,157 the use of rolls where the core is of different diameters at its two ends, with a corresponding difference on the interior of the sleeve, with air pressure vents from the core.

The use of such sleeves opens up the need for a printing machine in which the sleeve removal can be carried out in situ on the machine itself.

When a new image is to be printed a new sleeve is provided and in the past this has meant the removal of the complete roller from the printing machine and its subsequent replacement after the sleeve has been changed. It is further necessary to re-adjust the contact pressures between the sleeve and the impression cylinder and the sleeve and the inking roller. All of these operations are costly, both in terms of labour charges and of unproductive or downtime of the printing machine.

SUMMARY OF THE INVENTION

A considerable part of these expenses are avoided if the printing sleeves of all types are changed while the printing roll remains in the printing machine and enabling this is the subject of the present invention.

According to one aspect of the present invention therefore, there is provided a printing machine having at least one printing roll with a removable sleeve which provides its printing surface, the roll being journalled in side frames of the machine one beyond each axial end of the roll by bearings in the respective side frames, the bearing in one of those frames being removable from the side frame and from the roll so as to allow for operations to be carried out upon the roll from that axial end, and means beyond the other side frame for counterpoising the roll when the removable bearing has been removed.

In another aspect of the invention there is provided a method of changing a sleeve upon a printing roll which is borne in journals in a printing machine which consists of removing one only of the journals from the roll so as to leave that end of the roll axially accessible, counterpoising the mass of the roll by applying downward pressure beyond the other of the journals to an axle extending from the roll, removing a sleeve from the roll by axial movement over the said end of the roll, replacing the sleeve by a fresh sleeve and repositioning the first mentioned journal in the printing machine.

DESCRIPTION OF THE DRAWINGS AND OF A PREFERRED EMBODIMENT

Figure 2:
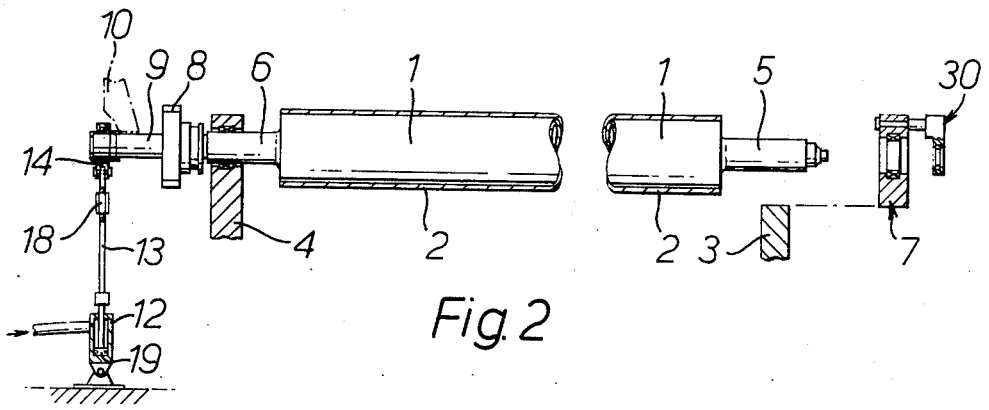
Figure 3:
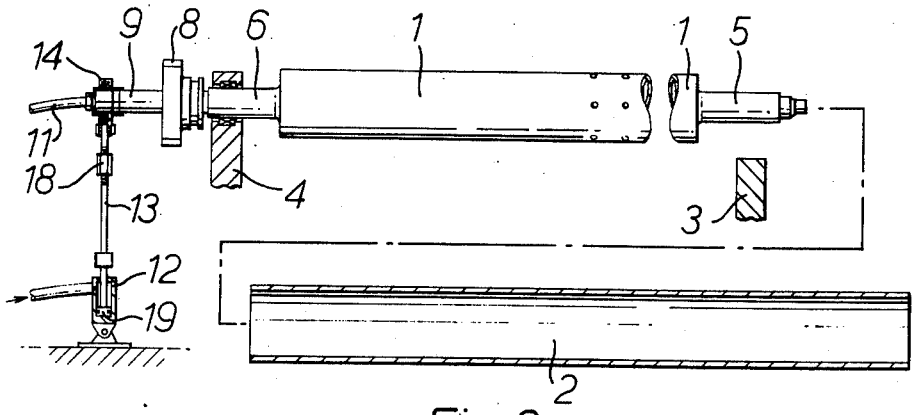
Figure 4:
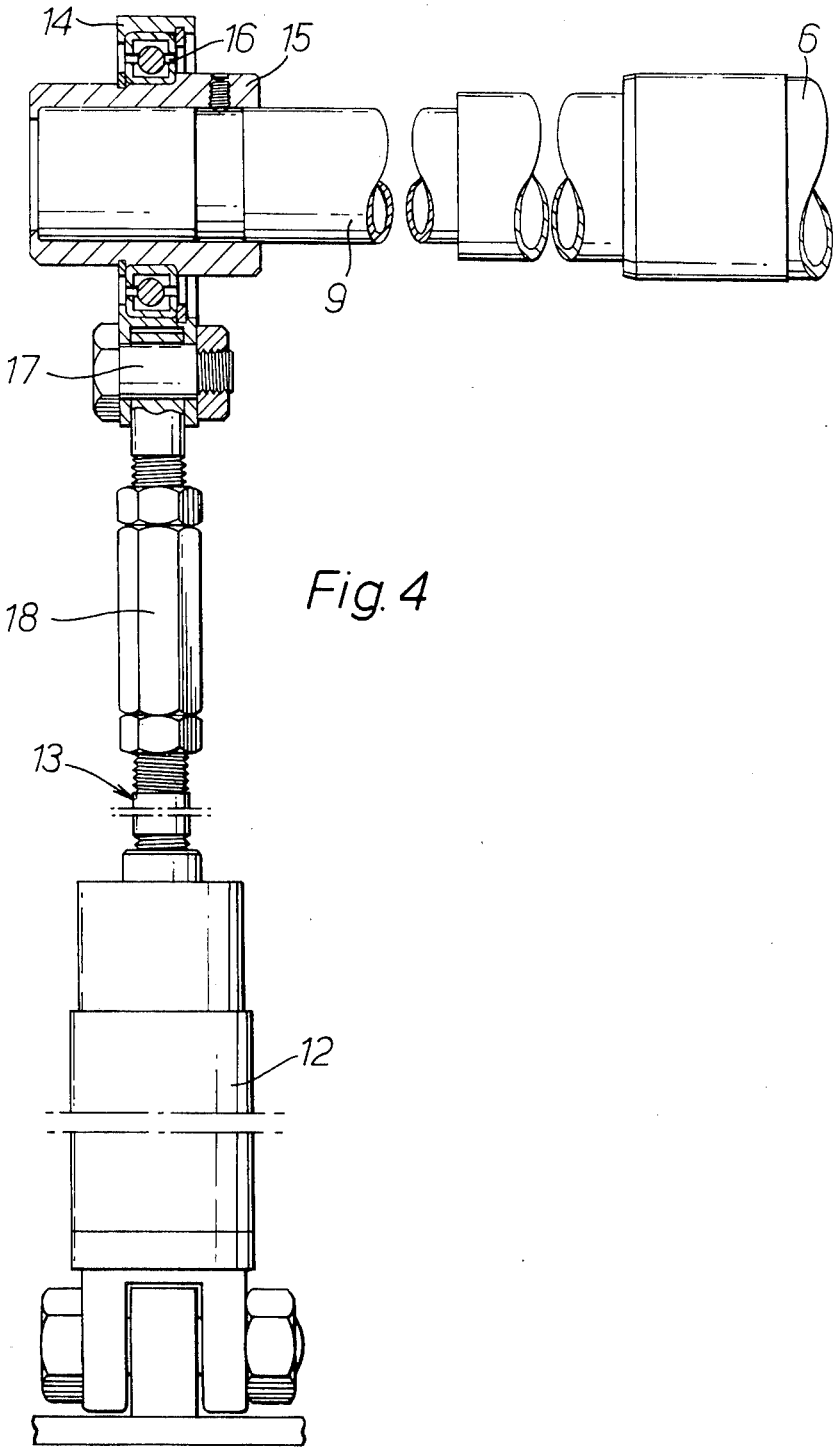
Figure 5:
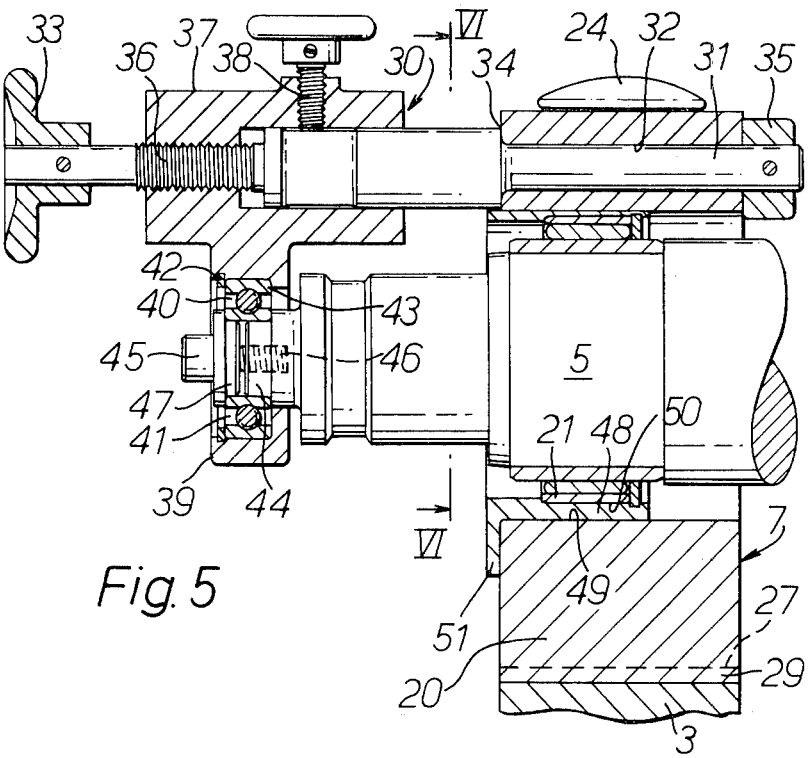
Figure 6:
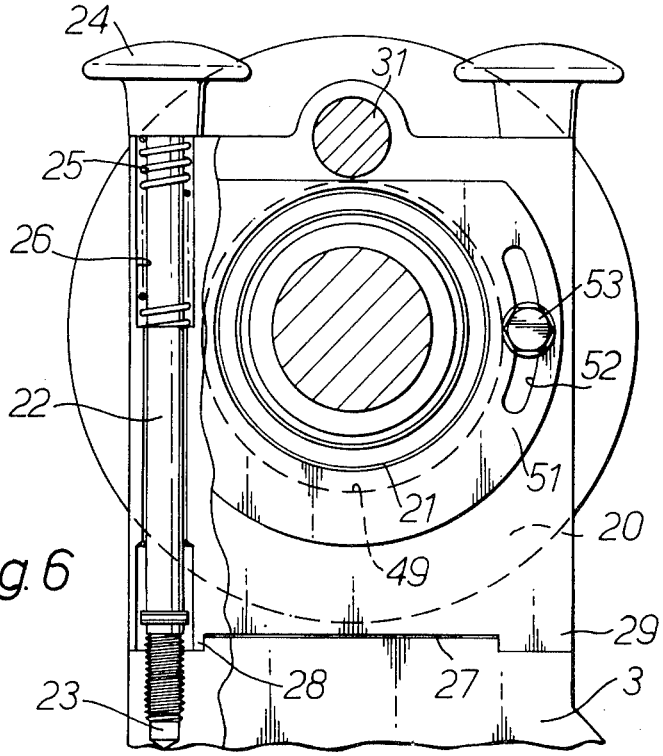

A particular embodiment of the invention and method of carrying it out will now be described with reference to the accompanying drawings wherein:

FIGS. 1, 2 and 3 show in side elevation and partial section three successive stages in carrying out the method, FIG. 4 is a side view, on a larger scale, of a counterpoising means, FIG. 5 is a section of a removable journal, and FIG. 6 is a section on the line VI—VI of FIG. 5, some parts being further cut-away.

FIG. 1 shows diagrammatically the normal working condition of a printing machine with a printing roll 1 fitted with a demountable printing sleeve and in position in the printing machine, of which side frames are seen at 3 and 4 respectively. The roll 1 has axles 5 and 6 which are journalled in side frame 3 and bearing block 7 borne on side frame 4. As will be explained in more detail the bearing block 7 is removable. Beyond the other of the journals is provided conventional drive gear 8 and an extension 9 of the axis 6.

The sleeve 2 is of a type which is removable from the roll 1 as is particularly valuable in flexographic printing. In particular, the roll 1 may have ends of different diameters, with a corresponding difference on the inner surface of the sleeve and be provided with pneumatic removal means as has been described in the said co-pending patent application.

To remove the sleeve 2 while the roll remains in situ in the printing machine, the bearing block 7 is removed axially, a counterpoise for the mass of the roll 1 being provided. In a simple version, the counterpoise is a stop 10 in the form of a bracket which is placed in position on the side frame of the machine and bears downwardly on the axial extension 9.

A stop 10 is seen in dotted lines in FIG. 2, for example.

In a preferred system, a counterpoise is provided by a hydraulic cylinder 12 pivotally anchored to the machine frame or floor and acting through a pull rod 13 and yoke 14, surrounding the extension 9 of the roll axle and engaged to it by a removable end-cap 15. The end-cap normally remains permanently engaged on the axle extension, and is rotatable within the yoke 14 in roller bearing 16.

A pivot 17 links the rod 13 to the yoke 14. The rod 13 includes a turnbuckle 18 which is set so that, when pressure is applied within the cylinder 12 to drive the piston 19 (coupled to the rod 13) downwardly to its fullest extent (see FIG. 2), the roll 1 is maintained in substantially the same position as it occupied when working, but separated by a small distance from both impression and inking rollers, and with the driving gear 8 remaining in partial engagement with the gear train as is normal when a printing machine of this type is stationary. Then, as seen in FIG. 3, an air-line 11 is brought up to an air inlet provided in the end of the axial extension 9, air is passed to the hollow core of the roll 1 escaping by apertures provided in its surface, and the sleeve 2 is slid axially off the roll over the axle 5. The removal of the bearing block 7 has allowed access to that end of the roll. To fit a sleeve, all that needs to be done is the bringing up of a fresh stage of the pneumatic means as described in the said co-pending application, the returning of the bearing block 7 into position and the machine is then ready to work. Of course, the present invention is equally applicable to any other sleeve-removal systems which require free access to one axial end of a roll core.

The removable bearing block is seen in more detail in FIGS. 5 and 6.

The side frame 3 terminates in a separate block 20 which incorporates a rolling contact bearing 21 which runs on the journal 5. The bearing is axially immovable in the block. The block 20 is screwed down onto the side frame 3 by long-stemmed bolts 22 engaging in threaded bores 22 in the side frame 3 and turnable by hand knobs 24. A spring 25 is compressed between the undersurface of nob 24 and an end of an enlarged housing 26 in the block 20. For exact positioning of the block 20 side walls of a platform 27 on the side frame 3 engage tightly with side walls of respective ridges 28,29 on the block.

Because the bearing block 20 must be axially slidable off the roll journal 5, the bearing 21 has no axial retention capacity, its inner race sliding freely on the journal 5. Axial retention capacity is provided by an adjustable restrainer 30.

A rotatable shaft 31 is borne in a bore 32 in the block 20 (in FIG. 6 the restrainer 30 has been removed). It is rotatable by hand knob 33 and is axially immovable relative to block 20, being retained by a shoulder 34 and collar 35. It is screw-threadedly engaged at 36 with a restrainer body 37. A locking screw 38 in the body 37 can be tightened onto the shaft 31 to prevent it rotating.

The body 37 has an apertured lug 39 which acts as a yoke receiving within its circular aperture 40 a rolling contact bearing 41 which is axially retained by circlip 42 and shoulder 43. An extreme end portion of the axle 5 is made up of an integral part 44 of a diameter to engage within the bearing 41 and of a separate screw part 45 which is screw-threadedly engaged with the shaft 5 by means of a screw-threaded post 46 of the part 45.

In the running condition of the machine a shouldered washer 47 is clamped to the bearing 41 by screw part 45. The axial position of the roll is adjusted by rotation of hand screw 33 and is locked by locking screw 38.

To remove the journal (the machine being stopped) and after the counterpoise has been provided, the screw part 45 is unscrewed and shouldered washer 47 removed. Bearing 41 is now free to be slid axially off the shaft part 44 and now the whole bearing block 20 may be removed, once bolts 22 have been undone. Bearing 21 offers no impediment to this removal.

The bearing 41 is housed in a flanged bush of which the bush part 48 has an outer diameter 49 eccentric of its inner bore diameter 50, the latter being the diameter which receives the outer race of bearing 21. The flange 51 of the bush has an arcuate slot 52 by which a bolt 53 can lock the bush in a desired attitude, so that the eccentricity of the bush corrects for errors in printing plates or sleeves on the roll, in a manner known per se.

I claim:

1. In a printing machine having at least one printing roll with a removable sleeve which provides a printing surface on the roll, said roll having a shaft member on each end and being journalled in side frames of the machine one beyond each axial end of the roll by bearings in the respective side frames, each said shaft member extending beyond each respective side frame, the improvement comprising:

a removable block in one of said frames, said block having at least one dimension greater than the radius of said sleeve, the bearing in said one frame being in the removable block;

means for allowing the removal of said block from its position in the said one side frame and of the bearing from the roll, so as to allow for axial sleeve-removal and fitting operations to be carried out upon the roll from that axial end when said roll is maintained substantially in its working position; and, means beyond the other side frame and acting on a said extending shaft member for counterpoising said roll and maintaining it substantially in said working position when said removable block has been removed from its position in the said one side frame.

2. A printing machine having at least one printing roll, said machine comprising:

a removable sleeve having axial ends, said sleeve being mounted on said roll, said roll having an axis and a shaft member at each end and being journalled in the side frames of said machine one beyond each axial end of said roll by bearings positioned in the respective side frames; said shaft member extending beyond each respective side frame, means for permitting the release of the bearing in one of said frames from being positioned in the side frame comprising a block in the side frame supporting the bearing;

means for removably securing said block in its position in the said frame, said block being removable from its position in the side frame to give axial access from beyond the said one side frame to the whole of an end of said sleeve; and, means beyond the other side frame and acting on a said extending shaft member for counterpoising the roll when said removable block has been removed thereby maintaining the roll substantially in its working position, whereby said sleeve may be removed from said roll through the location from which said block has been removed.

3. A printing machine according to claim 2 wherein the bearing in said one frame is secured to the one said shaft member by entrapment of an inner race thereof between a shoulder on the one said shaft member and an end cap removably secured to the end of the one said shaft member.

4. A printing machine according to claim 2 wherein the block is securable to the one said side frame by hand-rotatable bolts lying in a common vertical plane normal to the axis respective of the said shaft member, and means interengaging between the block and the side frame for determining the position of the block on that frame.

5. A printing machine according to claim 2 wherein the counterpoise means is a bracket positionable to abut an end portion of the said shaft member beyond the other side frame.

6. A printing machine according to claim 2 wherein the counterpoise means is a pull-rod, coupled to the end portion of the said shaft member beyond the other side frame through a yoke and a rolling-contact bearing and actuable in a downward direction by an anchored piston and cylinder arrangement.

7. A printing machine according to claim 6 wherein the pull-rod includes means for adjusting its length, the said means being set such that the desired maintenance in position is achieved when the piston in the piston and cylinder arrangement has reached the end of its stroke.

8. The printing machine according to claim 2 wherein means removably connect a restrainer to one said shaft member of the roll to interact with it to determine axial positioning of the shaft member relative to the side frame.

9. A printing machine according to claim 8 wherein said restrainer comprises a body and a rod, said rod being connected to said block, said body and rod being engaged together by means whereby relative rotation of the body and said rod about the axis of said rod alters their relative position, said rod extending parallel to the axis of the roll shaft and being rotatable to thereby alter the axial position of said body relative to said block, and a bearing coupling said body to said shaft, the said coupling bearing being such as to resist change of relative position between itself and said shaft member.

10. A method of changing a sleeve on a printing roll while the roll is in a printing machine comprising the steps of (a) providing a printing machine with a printing roll having axial ends, the roll comprising a removable sleeve having axial ends, the roll having an axis and a coaxial shaft member at each end and being journalled in the side frames of the machine one beyond each axial end of the roll by bearings positioned in the respective side frames; said shaft member extending beyond each respective side frame, means for permitting the release of the bearing in one of said frames from being positioned in the side frame comprising a block in the side frame supporting the bearing;

means for removably securing said block in its position in the said frame, said block being removable from its position in the side frame to give axial access from beyond the said one side frame to the whole of an end of said sleeve; and, means beyond the other side frame and acting on a said extending shaft member for counterpoising the said roll when said removable block has been removed thereby maintaining the roll substantially in its working position, (b) counterpoising the weight of the roll by the counter poising means applying downward force on said extending shaft member at one end of the roll whereby to maintain the roll substantially in working position when the block and the roll bearing have been removed, (c) removing the block from the side frame so as to leave that end of the sleeve axially accessible from beyond the side frame while the roll is in substantially its working position, (d) while the roll is counterpoised, removing the sleeve from the roll in an axial movement led by said accessible end, (e) while the roll is counterpoised, placing a fresh sleeve on the roll over and the said one end of the roll by an axial movement and, (f) replacing the block and bearing in position.

* * * * *